US009395129B2

(12) United States Patent
Ball

(10) Patent No.: US 9,395,129 B2
(45) Date of Patent: Jul. 19, 2016

(54) LIGHT EMITTING FIREARM MAGAZINE INDICATOR

(71) Applicant: Michael L Ball, Madera, CA (US)

(72) Inventor: Michael L Ball, Madera, CA (US)

(73) Assignee: Advanced Combat Solutions Inc., Fort Lauderdale, FL (US)

( * ) Notice: Subject to any disclaimer, the term of this patent is extended or adjusted under 35 U.S.C. 154(b) by 0 days.

(21) Appl. No.: 13/748,803

(22) Filed: Jan. 24, 2013

(65) Prior Publication Data

US 2014/0202056 A1 Jul. 24, 2014

Related U.S. Application Data

(60) Provisional application No. 61/590,465, filed on Jan. 25, 2012.

(51) Int. Cl.
*F41A 9/62* (2006.01)

(52) U.S. Cl.
CPC ..... *F41A 9/62* (2013.01)

(58) Field of Classification Search
CPC ..... F41A 9/62
USPC ..... 42/1.02
See application file for complete search history.

(56) References Cited

U.S. PATENT DOCUMENTS 954,904 A * 4/1910 White ..... F41A 19/30 42/1.02
4,020,203 A * 4/1977 Thuler ..... F41G 1/32 250/458.1
4,109,401 A * 8/1978 Musgrave ..... F41A 9/62 42/1.01
4,587,756 A * 5/1986 Jakubaschk ..... F41A 9/62 42/1.02
5,052,138 A * 10/1991 Crain ..... F41A 9/62 42/1.02
5,206,444 A * 4/1993 Oliver ..... F41A 9/62 42/1.02
5,522,167 A * 6/1996 Teetzel ..... F41A 9/62 250/208.4
2008/0276517 A1* 11/2008 Delgado ..... F41A 9/62 42/1.02
2010/0088944 A1* 4/2010 Callihan ..... F41G 1/32 42/145
2010/0115815 A1* 5/2010 Gur-Ari ..... F41A 9/62 42/1.02

* cited by examiner

*Primary Examiner* — Stephen M Johnson
*Assistant Examiner* — Benjamin Gomberg
(74) *Attorney, Agent, or Firm* — Craig R. Miles; CR Miles P.C.

(57) ABSTRACT

An apparatus known as a self-illuminating light-emitting firearm magazine indicator, or simply, light-emitting magazine indicator, (LEMI), is described here forth. The light-emitting firearm magazine indicator makes use of a self-illuminating device. The device and/or materials could comprise: radioactive gaseous isotopes, self-illuminating paint or any other substance that contains self-luminous properties. The light-emitting firearm magazine indicator will make use of any form of self-illumination technology that require no external power source or battery technology in order to give off light emissions. The light-emitting firearm magazine indicator will use the properties of radio-luminescence as a primary, but not exclusive source to create such attributes. The light-emitting firearm magazine indicator will do the above in order to provide a visual indication of magazine contents or capacity of ammunition in low light to zero light conditions, where firearm magazine contents or capacity of ammunition would otherwise be visually imperceptible without the use of said self-luminous device or the use of an external light source.

8 Claims, 4 Drawing Sheets

LIGHT EMITTING FIREARM MAGAZINE INDICATOR

CROSS-REFERENCE TO RELATED APPLICATIONS

This application claims the benefit of Provisional Patent Application Ser. No. 61/590,465, filed 2012 Jan. 25 by the present inventor.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

SEQUENCE LISTING

Not applicable.

The following is a tabulation of prior art that presently appears relevant:

| application Ser. No. | File Date | Pub. No. | Pub. Date | Patentee |
|---|---|---|---|---|
| 12/890,792 | Sep. 27, 2010 | US2011/0016760 | Jan. 27, 2011 | Joseph C. Longo |

FIELD OF INVENTION

This invention is directed toward the field of small arms class of firearms; handguns, rifles, and shotguns, and to the assemblies and sub-assemblies that comprise them as a whole. This invention relates specifically to the device(s) used in conjunction with aforementioned firearms known as a magazine. The magazine is a necessary device in many make and model of firearm that provide the means by which ammunition is loaded into a firearm. A magazine is also referred to in the firearms industry as, a mag or clip, in this document the terminology will be used interchangeably, unless otherwise specified. Furthermore, a magazine can belong to any semi-automatic or fully automatic class of firearm. The present invention can, and has intent to be applied to all type of magazine in all classes of firearm.

BACKGROUND OF THE INVENTION

This invention pertains to an apparatus known as a self-illuminating light-emitting firearm magazine indicator, or simply, light-emitting magazine indicator, (LEMI). The creation of a self-illuminated light-emitting firearm magazine indicator will provide a visual indicator of magazine contents, specifically the capacity of or rather quantity of ammunition contained within the structure of a conventional firearm magazine. The contents of, specifically the quantity of ammunition contained or remaining is of great importance to the firearm operator. The idea of knowing the quantity of ammunition remaining in a magazine is of utmost importance to the person(s) whose duty it is to carry a firearm on their person in the scope of their job. Military and law enforcement personnel are two specific examples of these types of individuals. The risks are substantially increased in not immediately being able to identify the quantity of ammunition remaining in a conventional firearm magazine in a hostile or combat environment. The risks further increase when identification of magazine contents or ammunition quantity remaining depends upon daylight or lack thereof affecting visual perceptibility. An inability to make instantaneous verification of ammunition quantity remaining in both day and night conditions can be lethal to the aforementioned groups, as situational awareness inclusive of the tools of their trade is a requisite of their job responsibilities and combat effectiveness. Moreover, within the course of these duties taking place irrespective of time of day; it is required that steps taken during daylight hours to verify the quantity of remaining ammunition in the magazine are repeatable where low-light to zero-light conditions exist. Instantaneous magazine remaining ammunition checks become of paramount importance for firearms operators when deployed into war, where split seconds can determine life or death for them.

To date there have been no attempts to provide a self-luminous light-emitting magazine indicator capable of instantaneously allowing the firearm operator the ability to verify the state of the firearm magazine contents or capacity of ammunition specifically in low-light to zero-light conditions.

Some current firearm magazines provide "peep-holes" drilled into the back or side of the magazine. Others provide integrated plastic windows by which to view magazine content or ammunition capacity. These features fulfill their intended purpose; to view magazine remaining ammunition in ample light conditions only. None of them were designed from inception to, nor allow for, the same visual confirmation steps taken in lighted conditions to be taken in low-light to zero-light conditions without the use of an external light source.

Magazines that have been designed in this manner with "peep-holes" and plastic windows have been done so primarily for use in the civilian market or gaming or toy market where instantaneous visual magazine remaining ammunition confirmation in either day or night is not life-threatening, nor is needed. Unfortunately, the hours of operation for war or policing activities do not only take place between the hours of 8:00 am to 5:00 pm, or solely located on a shooting range in broad daylight.

Currently, all other firearm magazines rely on visual confirmation of magazine remaining ammunition quantity during lighted conditions provided by the sun, or an artificial light source. However, as is most often the case both military and law enforcement personnel engage in combat during low-light or the zero-light conditions of nighttime. This further limits the ability of the firearms operator to utilize current conventional firearm magazines with their capacity checking features to fulfill their intended purpose when utilized in low-light or zero-light conditions.

Firearms manufacturers while making claims of their firearms being designed and purpose built for use in combat and warfare activities have done nothing in the area of addressing the combat effectiveness of firearm magazines. Most if not all current manufacturer magazines are at best difficult to confirm their capacity or remaining ammunition quantity visually even in lighted conditions, much less instantaneously and are virtually impossible to confirm in low light or zero-light conditions.

All firearms manufacturers make it a key and primary claim the main reason for the "peep-holes" and plastic windows in current conventional magazines they manufacture is for the firearm operator to easily identify remaining quantity of ammunition within the magazine. The present invention considers one of its primary claims to be tactical practicality and increased combat effectiveness by way of improved visual indication of magazine contents or capacity of ammunition. Moreover, the invention provides increased versatility and safety, both being a welcome secondary by-product.

There is a need in the art for the uniformity of both universal functionality, (magazine manipulation performed in daylight can also be replicated at night), and safety. Changing environmental lighting conditions should not detrimentally impact the operational usability and safety of firearm magazines as is currently the case. The present invention seeks to add an additional factor in helping to preserve the uniformity of both universal functionality and safety in a constantly changing environment.

OBJECT OF THE INVENTION

The objective of the invention is the creation of a self-illuminated light-emitting firearm magazine indicator that will provide a visual indication of magazine contents, specifically the capacity of or rather quantity of ammunition contained therein. The invention will primarily utilize naturally occurring radioactive isotopes as a source of illumination technology. This technology requires no external power source, no chemical energy source or battery-powered source of energy in order to give off light emissions. The invention will look to use the properties of radioluminescence as a primary, but not exclusive source to create such attributes.

SUMMARY OF THE INVENTION

The present invention discloses a means for providing a visual indication of magazine contents or capacity of ammunition in low light to zero light conditions by use of a self-illuminating light-emitting device integrated into a conventional firearm magazine. The apparatus will be integrated into a conventional firearm magazine that stores ammunition within its structure. The light emitting means is based primarily on radioluminescence technology. The light emitting means receives its energy source from the use of gaseous tritium light sources (GTLS), which is one type of radioluminescent material.

The use of GTLS is currently an established standard for radioluminescence technology in the firearms industry as it has been used for over two decades with proven superior functionality for its intended use. To date, the only currently known use of tritium in firearms components, assemblies, subassemblies, mechanism(s), and the like are its integration into firearms sights. The sights on any firearm contain a pair, both the front and the rear sight. These sights can contain tritium vials that are embedded into either or both sights.

The benefits of using tritium as a primary source of radioluminescent material directly relates back to the objective of this invention.

Gaseous tritium light sources are;

Self-Illuminated

- Available in extremely tiny glass vials hermetically sealed, making them versatile as an embeddable component into an existing firearms assembly or mechanism such as a firearm magazine
- Coated on the inside of the vial with phosphorescent material, which is available in different colors depending on preference and desired brightness level
- Filled with only trace amounts of tritium gas, making them virtually harmless
- Emitting electrons that activate the phosphorescent material permanently, without the need of external power, or even a charging catalyst
- Capable of having a life-span of at least 10 years, before the need to replace

DETAILED DESCRIPTION OF PREFERRED EMBODIMENT AND METHOD

Figure 1A:
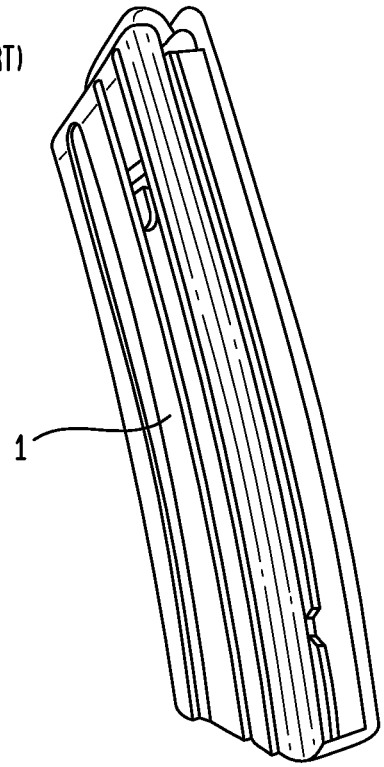
FIG. 1A (CONVENTIONAL ART)
FIG. 1A shows a rear-left-side view of an assembled firearms magazine.

The light-emitting firearm magazine indicator, (LEMI), (FIG. 1E), is designed to be, and can be applied universally to all makes and models of firearm magazine. This encompasses handguns, rifles, and shotguns. Although these categories of firearms fulfill very different roles as well as have different internal/external structures, they also share much of the same design as it pertains to the internal and external structure of the contemporary conventional firearm magazines they utilize. Examples of the aforementioned magazines most commonly shared structural similarities are displayed in the following drawings: FIG. 2A, FIG. 2A-2, FIG. 2A-4

Categories of firearms relevant to the LEMI invention include the following;

- Handgun—semi-automatic, single shot, full automatic(select-fire)
- Rifle—semi-automatic, bolt action single shot, full automatic(select-fire)
- Shotgun—pump action, semi-automatic and full automatic (select-fire)

Structural similarities of magazines, (FIG. 1A), used by all categories of firearm fed ammunition, (FIG. 2A-3), via a magazine are; a follower component, (FIG. 1B), by which ammunition, uses as a base by which to load upon itself, a spring component, (FIG. 3A-8), that attaches to the follower, (FIG. 2A-2), in a semi-permanent manner and provides the opposing force against the weight of ammunition, (FIG. 3A-6), being forced up and out of the magazine body, (FIG. 3A-5).

Figure 1B:
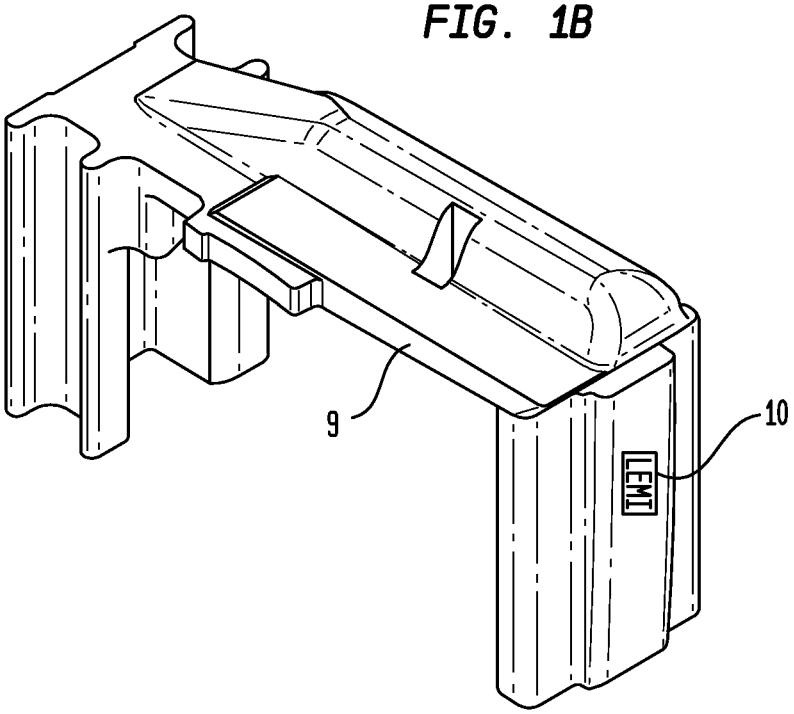
FIG. 1B shows a close up view of the magazine follower.
Figure 1C:
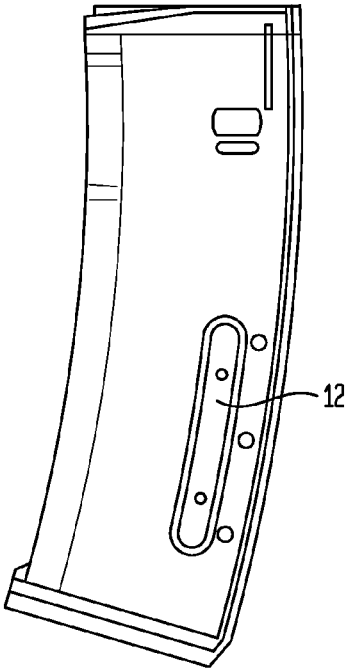
FIG. 1C (CONVENTIONAL ART)
FIG. 1C shows a side view of a non-transparent magazine.
Figure 1D:
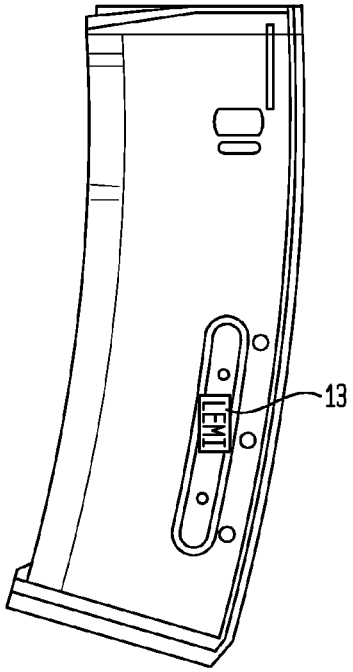
FIG. 1D shows a view of a Light Emitting Magazine Indicator (LEMI) as seen through the side window of FIG. 1C.
Figure 1E:
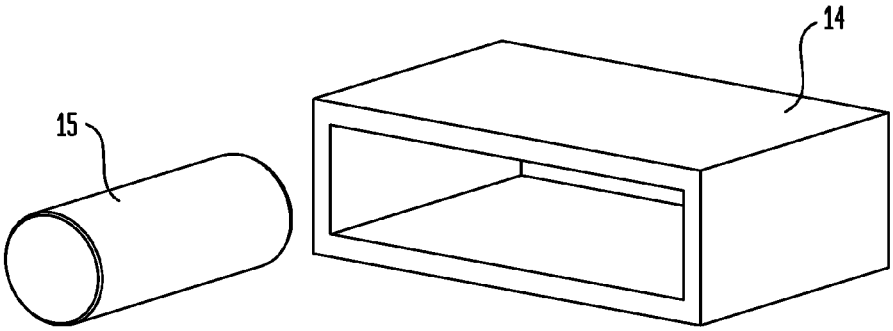
FIG. 1E shows components of a LEMI.
Figure 2A:
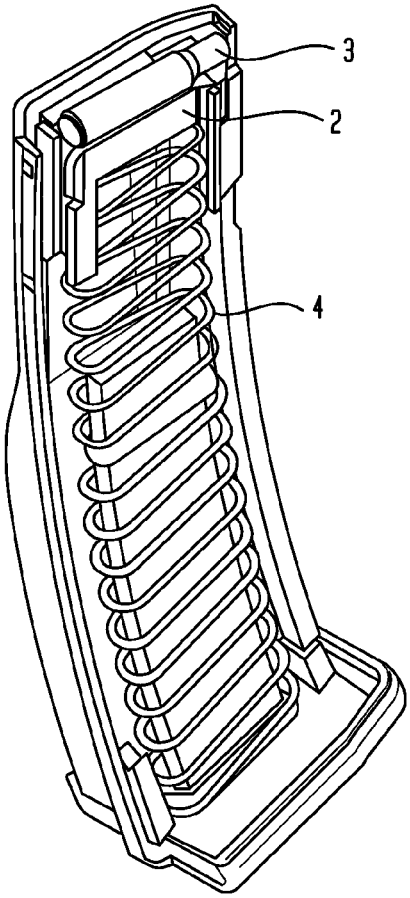
FIG. 2A (CONVENTIONAL ART)
FIG. 2A shows a cross-sectional view of the magazine of FIG. 1A.
Figure 2B:
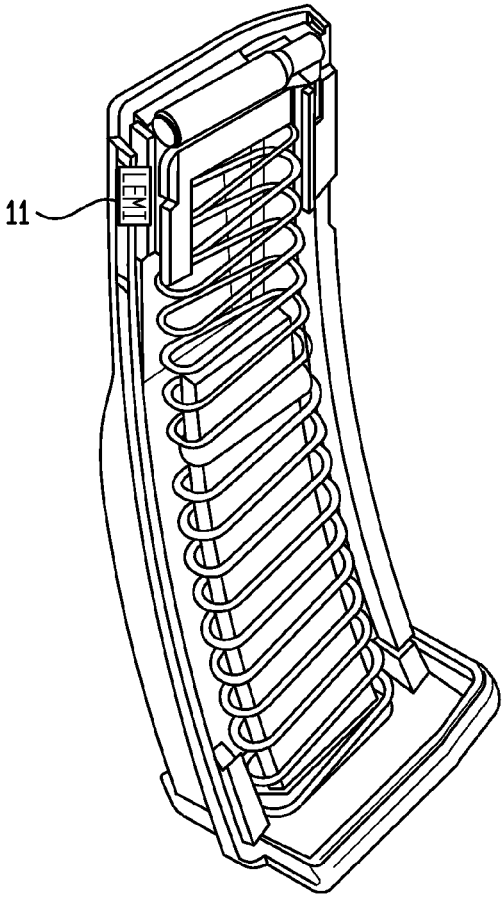
FIG. 2B shows a cross-sectional view of the magazine with a LEMI near an opening of the magazine.

The utilization of the present invention known as the LEMI, (FIG. 1E) requires an integration of its componentry, (FIG. 1E-14, FIG. 1E-15), into one of the structures of the magazine. The integration can be either as part of the external or internal structure of the magazine. The forms of preferred embodiment of the LEMI include integration into the magazine follower, (FIG. 1B). Placement of the LEMI into, follower, (FIG. 1B), will in most cases be located at the rear-most section of the follower, (FIG. 1B-10), which faces the operator of the firearm when a magazine is inserted into the firearm. A fully-loaded transparent magazine, (FIG. 3A-5), with the LEMI installed, (FIG. 3A-7), will clearly make known to the firearms operator the current remaining cartridges in the magazine.

Figure 3A:
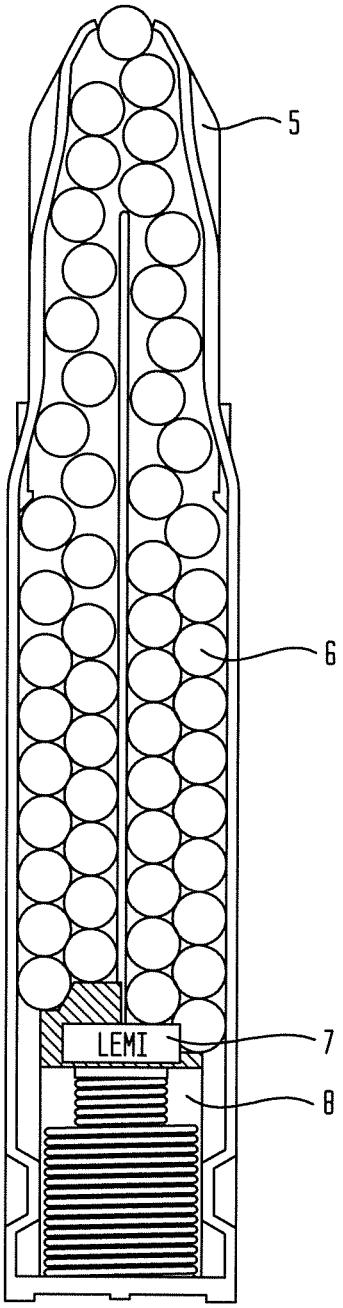
FIG. 3A shows a cross-sectional rear view of a loaded magazine with integrated LEMI.

When the LEMI is viewed from the firearm operator perspective, via a fully loaded, (FIGS. 3A-6), and installed magazine, FIG. 3A, in the firearm the LEMI, (FIG. 3A-7), will visually be apparent toward the bottom of the magazine, (FIG. 3A-7). When the firearm operator discharges ammunition contained therein, the follower assembly, (FIG. 1B), will travel in an upward direction toward the opening of the magazine. The LEMI, as an integrated part of the follower will travel in that same direction giving indication to the firearms operator that ammunition is being spent and what level of ammunition is remaining in the magazine until it comes to an empty state. The examiner of this document should again be reminded that the magazine bodies that allow for clear viewing of the LEMI invention are transparent magazine bodies or bodies that have windows on various external surfaces of the magazine body; these types of magazines are commonly sold in the public market place.

There are many different variations of how the LEMI could potentially be integrated into the magazine. The installation and use case scenario described in the previous paragraph is considered the best in form and most effective integration of the LEMI into a firearm magazine. However, the LEMI invention is certainly not limited to only that particular design of installation.

Here is an example of a common installation of the LEMI that has been integrated into a magazine, (FIG. 1C), whose body is not transparent. The LEMI is installed into the follower on a side surface, (FIG. 1B-9). The body of the magazine not being transparent instead has a window, (FIG. 1C-12), cut into it on both sides of its most broad and flat surfaces. Through this window the LEMI, (FIG. 1C-13), can be viewed, and the remaining capacity of ammunition be known to the firearm operator at all times depending on the position of the LEMI in relation to the top, (magazine empty), or bottom, (magazine full), or any position of the LEMI in between the two extremes.

The following are only some of the advantages of the LEMI technology. LEMI technology is designed to be, and can be applied universally to all makes and models of firearm magazine. This encompasses handguns, rifles, and shotguns. Although these categories of firearms fulfill very different roles as well as have different external structures, they also share much of the same design of internal components making ease of installation and adoptability a reality.

This shared commonality will allow for the following advantages;

Ease of introduction and acceptability into the firearms market

Ease of adaptability into existing firearms designs

Ease of suitability across multiple firearms categories

Ease of installation by even the firearms operator in some cases

Ease of troubleshooting if LEMI mechanism were to fail

What is claimed is:

1. A light emitting magazine indicator, comprising:

a spring-loaded follower engaging a stack of cartridges in a magazine adapted to serially supply cartridges from said stack of cartridges to a firearm, said spring-loaded follower having one of a plurality of positions in said magazine corresponding to a number of said cartridges remaining in said stack of cartridges;

a gaseous tritium light source connected to said spring-loaded follower, said gaseous tritium light source persistently emitting an amount of light in low light conditions without an energy source external to said magazine, said gaseous tritium light source positioned in relation to said spring loaded follower to emit said amount of light incident upon an internal surface of said magazine to provide a persistent visual indicator on said external surface of said magazine, said persistent visual indicator moving in response to said spring-loaded follower to each one of said plurality of positions of said spring-loaded follower in said magazine to indicate said cartridges remaining in said stack of cartridges contained in said magazine.

2. The light emitting magazine indicator of claim 1, wherein said gaseous tritium light source is embedded in said spring-loaded follower.

3. The light emitting magazine indicator of claim 2, wherein said gaseous tritium light source is embedded in a rear portion of said spring-loaded follower, said self-illuminating device emits said amount of light incident on a rear face of said internal surface of said magazine facing said operator to provide said visual indicator.

4. The light emitting magazine indicator of claim 1, wherein said firearm is selected from the group consisting of: a handgun, a rifle, and a shotgun.

5. The light emitting magazine indicator of claim 1, further comprising a holding framework connected to said spring loaded follower, said holding framework configured to hold said gaseous tritium light source.

6. The light emitting magazine indicator of claim 5, wherein said holding framework connected to said spring loaded follower is positioned to direct said amount of light emitted by said gaseous tritium light source incident on a rear face of said internal surface of said magazine facing said operator to provide said visual indicator.

7. The light emitting magazine indicator of claim 5, wherein said holding framework has a configuration adapted hold a plurality of said gaseous tritium light sources, said holding framework holding a plurality of said gaseous tritium light sources.

8. A method for making a light emitting magazine indicator, said method comprising:

connecting a gaseous tritium light source to a spring-loaded follower in a magazine of a firearm, said gaseous tritium light source persistently emitting an amount of light in low light conditions without an energy source external to said magazine, said spring-loaded follower engagable with a stack of cartridges in said magazine to serially supply cartridges from said stack of cartridges to said firearm, said spring-loaded follower having one of a plurality of positions in said magazine corresponding to a number of said cartridges remaining in said stack of cartridges, said gaseous tritium light source emitting an amount of light incident upon the internal surface of said magazine to provide a persistent visual indicator on said external surface of said magazine, said persistent visual indicator moving in response to said spring-loaded follower to each one of said plurality of positions of said spring-loaded follower in said magazine to indicate said cartridges remaining in said stack of cartridges contained in said magazine.

* * * * *